US005476625A

United States Patent [19]

Clatworthy

[11] Patent Number: 5,476,625

[45] Date of Patent: Dec. 19, 1995

[54] METHOD OF MANUFACTURING LIQUID-REPELLANT COVERING LAYER

[75] Inventor: John L. Clatworthy, Harringay-London, Great Britain

[73] Assignee: Pharo Limited, Dublin, Ireland

[21] Appl. No.: 339,741

[22] Filed: Nov. 14, 1994

[30] Foreign Application Priority Data

Apr. 5, 1994 [BE] Belgium ..... 09400352

[51] Int. Cl.[6] ..... B32B 7/00; B32B 7/08

[52] U.S. Cl. ..... 264/112; 264/122; 264/256; 264/257

[58] Field of Search ..... 264/112, 122, 264/256, 257

[56] References Cited

U.S. PATENT DOCUMENTS 5,237,945 8/1993 White ..... 112/420

FOREIGN PATENT DOCUMENTS 0491453 6/1992 European Pat. Off. .
0490529 6/1992 European Pat. Off. .
0563453 10/1993 European Pat. Off. .
9112500 1/1992 Germany .
4221329 2/1994 Germany .

*Primary Examiner*—Mary Lynn Theisen
*Attorney, Agent, or Firm*—Bacon & Thomas

[57] ABSTRACT

Liquid-repellant covering layer, characterized in that it consists of at least a compact layer (2) which is formed by a mass of fibers (3) and a clay product (4).

18 Claims, 2 Drawing Sheets

METHOD OF MANUFACTURING LIQUID-REPELLANT COVERING LAYER

This invention relates to a liquid-repellant covering layer and a method for the manufacture of such covering layer.

It is known that clay mats can be used for a liquid-tight covering.

Such clay mats, above all, are used in water basins, channels and such as a seal between the water and the soil; as a seal between the water and the supporting structures in roof gardens, cellars and such; as a seal for waste deposits in order to prevent the infiltration of rain water and/or to prevent the penetration of liquids into the soil underneath; as well as a cover for industrial installations, such as tank plants, gas stations, storage areas, production units and such, also in order to prevent the penetration of liquids into the soil underneath.

The existing clay mats usually are composed of a homogenous layer of clay which, at both sides, is provided with a layer of geotextile. This known embodiment shows the disadvantages that the clay can shift easily between or be released from the textile layers, which may lead to the forming of micro-cracks or breaches through which liquid can penetrate, and that the clay, when cutting such clay mats, can drop off at the edges from between the textile layers. It is also obvious that these clay mats are not very apt for vertical installation or installation onto a slope.

Another known embodiment is composed of a membrane (for example, polyethylene foil or similar) on which bentonite is adhered, which is provided at the opposite side with a protective fabric or not. Also in this case, the bentonite may easily be released, and the foil is very sensitive to perforation.

The present invention aims at a liquid-repellant covering layer wherein clay is applied, whereby penetration of liquid, as well because of the aforementioned reasons as because of other reasons, is excluded in a maximum manner.

Hereto, the invention in the first place relates to a liquid-repellant covering layer, characterized in that it consists at least of a compact layer which is formed of a mass of clay being reinforced by means of fibers.

In the most preferred embodiment, the said layer is provided with a coating and/or an armouring in order to further increase the mechanical properties of the covering layer.

The invention also relates to a method for the manufacture of such covering layer, characterized in that it consists of forming a mass of fibers; processing the mass of fibers and a clay product into each other; and compressing the whole to a compact layer. In this way, an especially coherent covering layer is obtained.

In order to optimally process the clay product between the fibers, one starts from an existing layer of fibers which is stretched into a mass of fibers having an open structure, or it is started from an existing mass of fibers having an open structure, and subsequently the clay product is brought between the fibers, preferably by injecting, spreading or blowing it into the mass of fibers in the form of particles or powder.

According to the invention, one may also start with an open-structured mass of fibers which, in the first place, is produced by the stacking of loose fibers, whereby the clay can also be brought in between by means of spreading, injecting or blowing.

In order to better show the characteristics according to the invention, hereafter some preferred embodiments are described, as examples without any restrictive character, with reference to the enclosed drawings, wherein:

FIG. 1 represents a rolled-up covering layer according to the invention;

FIG. 2, on a larger scale, represents a cross-section according to line II—II in FIG. 1;

Figure 1:
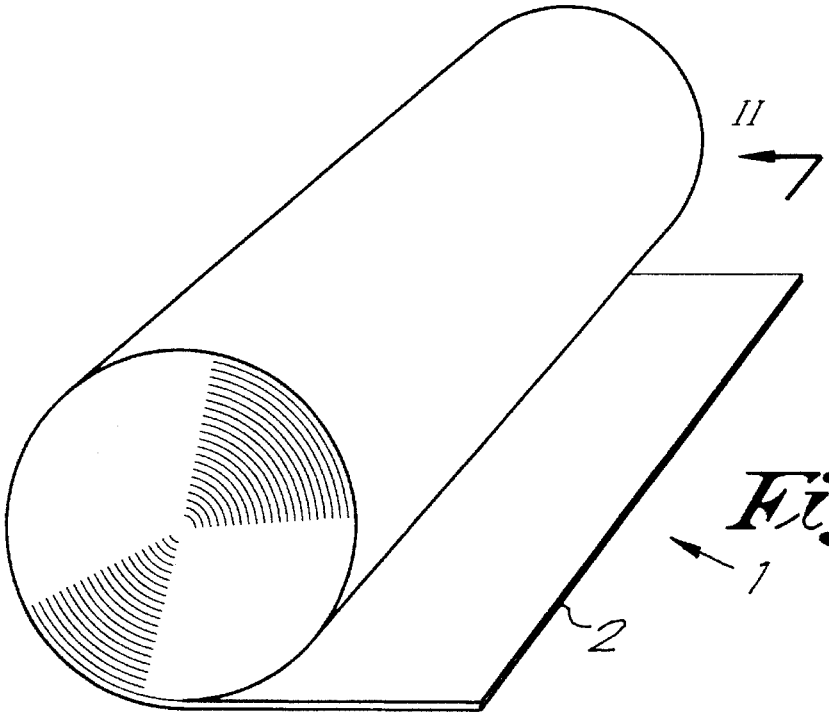
Figure 2:
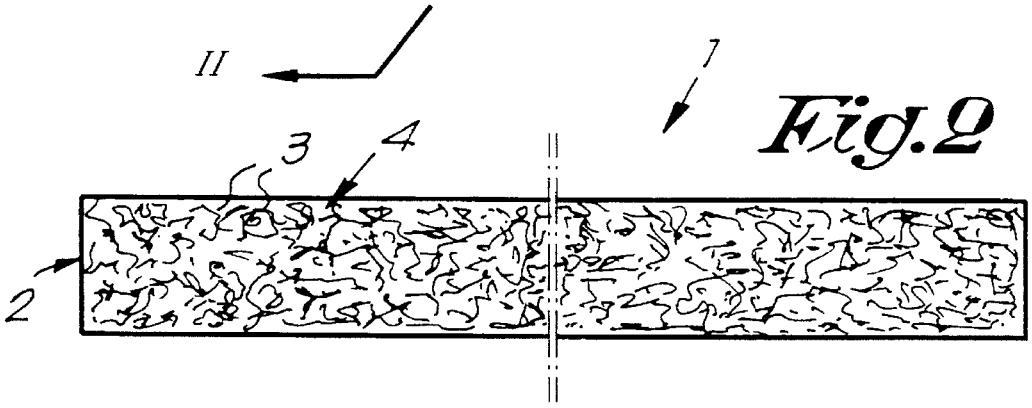

As represented in FIGS. 1 and 2, the invention consists of a covering layer 1, having the characteristic that it at least consists of a compact layer 2 which is formed of a mass of fibers 3 and a clay product 4, processed in between.

For the fibers 3, preferably glass and/or plastic fibers are used, however, to this end it is not excluded to apply other fibers, too, for example natural fibers. Preferably, use is made of a needled or nailed mass of fibers.

Although the said clay product 4 preferably consists of pure bentonite, it is not excluded to use a mixture based on clay, in other words, clay mixed with other materials.

Figure 3:
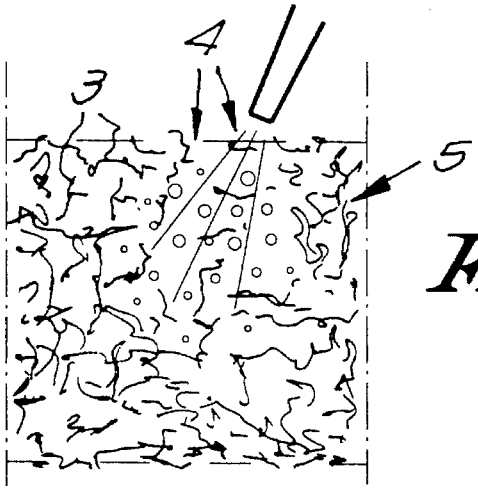
FIG. 3 represents a step of a method for the manufacture of such covering layer.

The covering layer 1 is preferably manufactured by subsequently forming a mass of fibers; processing the mass of fibers and the clay product 4 into each other; and compressing the whole to a compact layer 2. As represented in FIG. 3, hereby the mass of fibers and the clay product 4 can be processed into each other by stretching an existing layer of fibers until a mass of fibers 5, having an open structure, is obtained, and subsequently applying the clay product 4 between the fibers 3. It is obvious that hereby one can also start with an existing layer of fibers or mass of fibers which itself already presents an open structure.

As further represented in FIG. 3, the application of the clay product between the fibers 3 may be performed by injecting, spreading or blowing the clay product 4 into the mass of fibers 5, in the form of particles such as clay pellets or clay powder.

According to a variant, the mass of fibers 5 may also be formed by spreading the fibers over each other and injecting and/or spreading the clay particles herein.

The compression of the whole to a compact layer 2 can be performed in any manner. Preferably, this is realized by applying the whole to be compressed between two pressure plates or by rolling it flat and/or needling or nailing (needle punching ) it.

Figure 4:
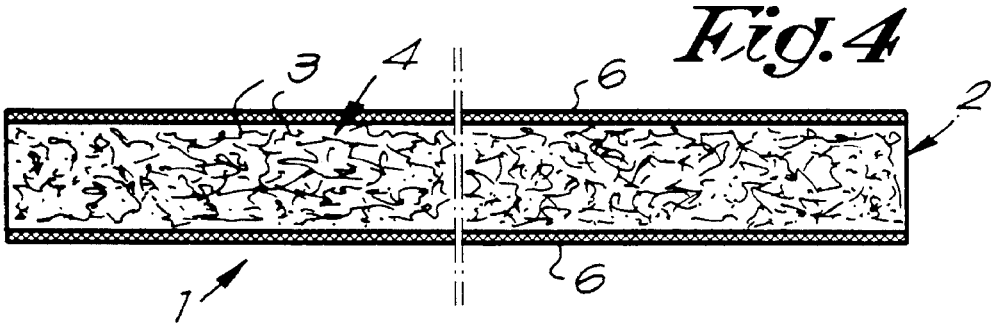
FIG. 4 represents a variant of a covering layer according to the invention.

As represented in FIG. 4, the said layer 2 may be provided with a coating 6, preferably at both sides thereof.

This coating 6 preferably consists of a textile layer, such as geotextile or a geomembrane.

The attachment of the coating 6 at the layer 2 may be performed by glueing, needling, stitching, thermic welding or by means of a combination of these techniques. Hereby, it is remarked that the fibers 3 which reach up to the outer side of the layer 2, allow an optimum adherence between the coating 6 and the layer 2.

According to a not represented variant, the covering layer 1 is provided with an armouring, for example of geotextile and/or metal and/or plastic, in order to increase its strength.

Figure 5:
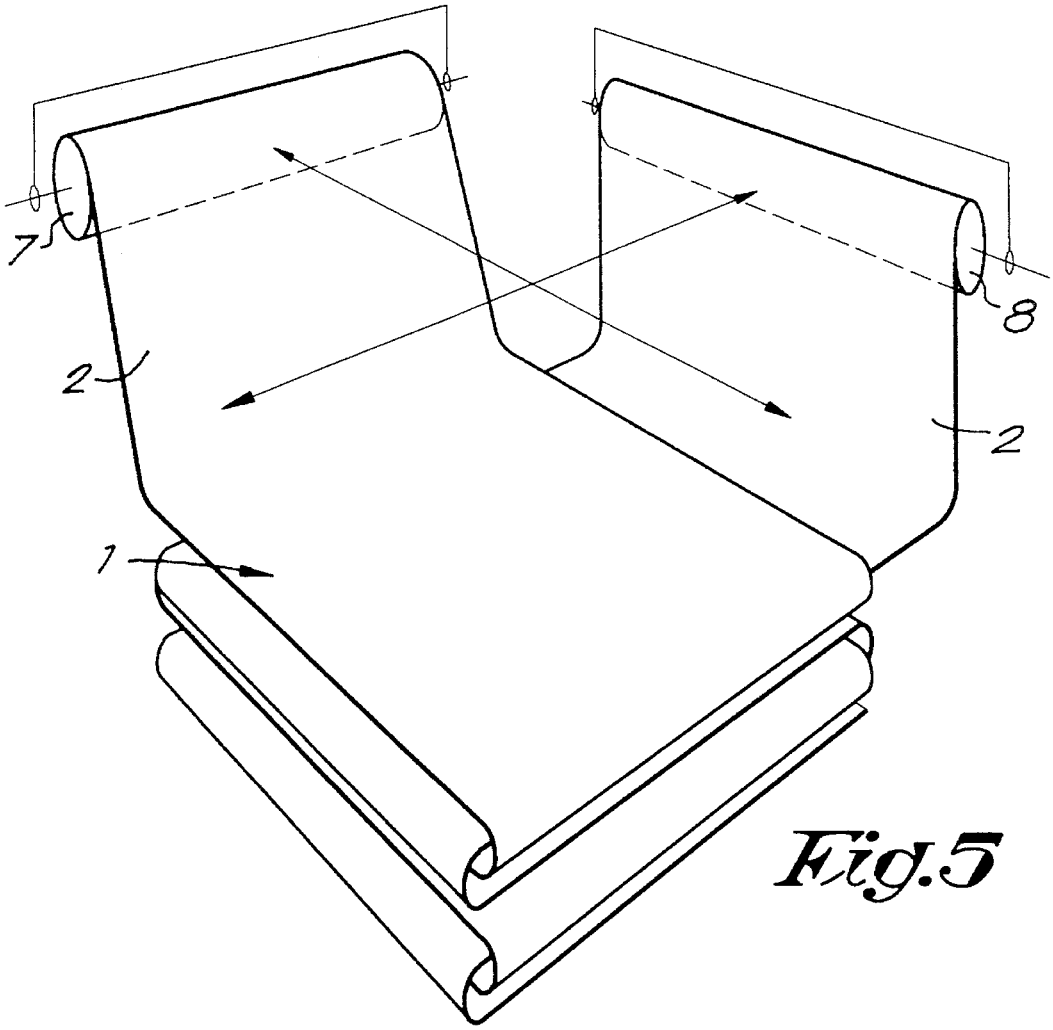
FIG. 5 represents an further embodiment of the invention during its composition.

According to the invention, the covering layer 1 may also be composed of several layers 2 which are applied on top of each other, with or without the inclusion of other layers. As schematically shown in FIG. 5, the layers 2 then preferably are placed crosswise over each other. As the layers 2 mostly show a greater strength in one direction than in the other direction, the crosswise placement on top of each other offers a maximum strength in all directions on the finally obtained covering layer 1.

As shown in FIG. 5, the crosswise structure hereby can be formed by unrolling covering layers 2 from two rolls 7 and 8 and applying them in a zigzag movement alternatingly on top of each other. This process can also be performed successively, first in one direction and then in the other and so on. During this process, the spreading or injection of clay pellets between the structures, unrolled in a zig-zag manner, is possible.

The mutual securing of the composing layers may also be realized by means of the aforementioned techniques.

The present invention is in no way limited to the embodiments described as examples and shown in the FIGS., however, such liquid-repellant covering layer 1 and the method for the manufacture thereof can be realized according to different variants without leaving the scope of the invention.

I claim:

1. A method for the manufacture of a liquid-repellant covering layer, which method comprises forming a mass of fibers; processing a clay product into the mass of fibers; and compressing the processed mass of fibers to a compact layer: wherein the clay product is processed into the mass of fibers by stretching an existing layer of fibers to an open structure and applying the clay product in the openings between the fibers.

2. A method according to claim 1, wherein the mass of fibers is formed by spreading, injecting or blowing fibers over each other.

3. A method according to claim 1, wherein the clay product is in the form of particles or powder, and is applied by injecting the particles or powder into the mass of fibers.

4. A method according to claim 1, wherein the clay product is in the form of particles or powder, and is applied by spreading the particles or powder into the mass of fibers.

5. A method according to claim 1, wherein the clay product comprises bentonite.

6. A method according to claim 1, wherein the fibers comprise glass fibers, plastic fibers, or a mixture thereof.

7. A method according to claim 1, wherein the fibers comprise a nailed or needled mass of fibers.

8. A method according to claim 1, wherein at least one side of the compact layer is coated.

9. A method according to claim 8, wherein the compact layer is coated on both sides.

10. A method according to claim 8 wherein the coating comprises a geotextile.

11. A method according to claim 9, wherein the coating comprises a geomembrane.

12. A method according to claim 1, wherein the covering layer further comprises an armor.

13. A method according to claim 12, wherein the armor is a metal armor.

14. A method according to claim 12, wherein the armor is a plastic armor.

15. A method for the manufacture of a liquid-repellant covering layer, which method comprises forming a mass of fibers; processing a clay product into the mass of fibers; and compressing the processed mass of fibers to a compact layer; wherein the coveting layer comprises a plurality of compact layers formed from fiber masses and a clay product, wherein the plurality of compact layers are applied crosswise over each other.

16. A method according to claim 15 wherein the plurality of layers are mutually connected by gluing, needling or nailing, stitching, thermic welding, or a combination thereof.

17. A method according to claim 15, wherein the plurality of compact layers is formed by unrolling coveting layers from two rolls and applying them in a zigzag movement alternatingly on top of each other.

18. A method according to claim 17, wherein clay pellets are spread or injected between the covering layers from the two rolls as the covering layers are applied in a zig zag movement alternatingly on top of each other.

* * * * *